US005083702A

United States Patent [19]

Wyberg

[11] Patent Number: 5,083,702

[45] Date of Patent: Jan. 28, 1992

[54] GABLE-TOP CONTAINER AND METHOD AND APPARATUS FOR CONSTRUCTION THEREOF

[75] Inventor: Gregory R. Wyberg, Minneapolis, Minn.

[73] Assignee: Minnesota Mining and Manufacturing Company, St. Paul, Minn.

[21] Appl. No.: 497,437

[22] Filed: Mar. 22, 1990

[51] Int. Cl.[5] ..... B65D 5/42

[52] U.S. Cl. ..... 229/125.42; 229/137; 229/249; 493/184

[58] Field of Search ..... 229/125.42, 137; 206/621.1, 621.2, 631.3; 493/133, 135, 156, 157, 184

[56] References Cited

U.S. PATENT DOCUMENTS

| | | | |
|---|---|---|---|
| 2,985,545 | 5/1961 | Leavitt | 117/143 |
| 3,116,002 | 12/1963 | Crawford et al. | 229/17 |
| 3,120,089 | 2/1964 | Monroe et al. | 53/86 |
| 3,178,089 | 4/1965 | Tobias et al. | 229/17 |
| 3,185,375 | 5/1965 | Thomas | 206/631.3 |
| 3,186,621 | 6/1965 | Svensson | 206/621.2 |
| 3,189,246 | 6/1965 | Seline, Jr. | 229/17 |
| 3,200,557 | 8/1965 | Schwenk | 53/39 |
| 3,239,995 | 3/1966 | Monroe et al. | 53/375 |
| 3,270,940 | 9/1966 | Egleston et al. | 206/631.3 |
| 3,291,369 | 12/1966 | Crawford | 229/37 |
| 3,292,842 | 12/1966 | Huang et al. | 229/17 |
| 3,309,841 | 3/1967 | Egleston et al. | 53/373 |
| 3,319,868 | 5/1967 | Huang et al. | 229/17 |
| 3,334,799 | 8/1967 | Crawford | 239/17 |
| 3,349,988 | 10/1967 | Horning | 206/631.3 |
| 3,355,083 | 11/1967 | Wilcox | 206/631.3 |
| 3,471,076 | 10/1969 | Crawford | 229/17 |
| 3,543,993 | 12/1970 | Rausing | 229/17 |
| 3,675,015 | 7/1972 | Geib | 250/71 R |
| 4,159,220 | 6/1979 | Bosche et al. | 156/73.1 |
| 4,313,553 | 2/1982 | Lisiecki | 229/17 G |
| 4,403,465 | 9/1983 | Bachner | 53/477 |
| 4,422,570 | 12/1983 | Lisiecki | 229/17 R |
| 4,518,377 | 5/1985 | Skinner | 493/58 |
| 4,582,246 | 4/1986 | Lisiecki | 229/17 R |
| 4,744,467 | 5/1988 | Johnson et al. | 206/631.3 |
| 4,756,426 | 7/1988 | Wyberg | 206/621.2 |
| 4,813,546 | 3/1989 | Gordon et al. | 206/621.2 |
| 4,860,902 | 8/1989 | Kieser | 206/631.3 |
| 4,903,891 | 2/1990 | Gordon | 229/631.3 |
| 4,946,041 | 8/1990 | Poole | 206/621.1 |

FOREIGN PATENT DOCUMENTS

| | | |
|---|---|---|
| 0028941 | 12/1980 | European Pat. Off. . |
| 0331792 | 9/1988 | European Pat. Off. . |
| WO82/01175 | 4/1982 | PCT Int'l Appl. . |
| 75/6322 | 6/1975 | South Africa . |
| 1120503 | 6/1966 | United Kingdom . |

*Primary Examiner*—Gary E. Elkins
*Attorney, Agent, or Firm*—Gary L. Griswold; Walter N. Kirn; Leland D. Schultz

[57] ABSTRACT

Disclosed is a gable-top container including structure for reducing the force required to open the container by inducing buckling in the first and second upper rib panels of the gable-top container.

17 Claims, 7 Drawing Sheets

GABLE-TOP CONTAINER AND METHOD AND APPARATUS FOR CONSTRUCTION THEREOF

BACKGROUND OF THE INVENTION

1. Field of the Invention

This invention relates to packaging, and particularly to a gable-top container suitable for the packaging of liquids, having improved opening characteristics and a method and apparatus for the construction thereof.

2. Description of the Prior Art

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels which are adapted to form the walls and closure members. The panels are formed and separated by score lines at which the blank is folded. Particular panels are intended to be joined together in a lapped arrangement in the completed container. Typically, those panels are pressed together and heated or exposed to high frequency radiation to fuse the adjoining thermoplastic surfaces and form a generally strong seal. To finally seal the filled container, two or more panels are finally joined and sealed to form a rib along the top edge of the roof panels.

FIG. 1 illustrates an exemplary flat sheet material blank for constructing a gable-top container. The inner surface or face is shown, and it is coated with a thermoplastic such as polyethylene. The outer surface may also be similarly coated. The sheet material may include a gas impermeable layer such as aluminum foil. An appropriate pattern of score lines divides blank 1A into a plurality of panels and sub-panels which are used as walls of the container and its closure parts when the container is erected.

The central portion of blank 1A comprises four body panels 2, 3, 4, and 5, having their lower edges along bottom score line 13, and their upper edges along top score line 31. These transverse score lines are shown as extending from blank edge 6 to opposite blank edge 12 in substantially parallel relationship across the face of the blank. Vertical score lines 7, 8 and 9 transect the blank to define the lateral edges of the body panel 2, 3, 4 and 5, and other panels above the body panels. These and other score lines are not necessarily straight, but may be slightly offset in certain sectors of the blank to improve the fit of the various panels in the erected container.

In the example shown in FIG. 1, side seam flap 11 is connected to one lateral edge 10 of a body member for sealing to the edge of another body member 2 by the container sealing process. Bottom closure means 26 is shown as a group of bottom closure panels 14 through 21 attached to the body members along bottom score line 13, and extending downward therefrom. Bottom closure score lines 22 through 25 enable bottom closure panels 14, 16, and 18–21 to be folded under closure panels 15 and 17 and sealed to provide a leakproof container bottom. Such a closure means is well-known in the art. A separately formed structure may alternatively be used to close the bottom of the container. In fact, any closure means which results in a satisfactorily tight seal may be used.

The gable-top of the container is formed from a series of panels above top score line 31. First and second roof panels 28 and 30 are connected to the upper edges of the first and second side panels 3 and 5, respectively. The roof panels are oppositely disposed and when erected, converge upwardly to meet along score line 44 to form a gable roof. Connected to the upper edge of the front panel 4 is a first substantially triangular end panel 29 whose two lateral edges 35 and 36 formed by score lines extend upwardly to score line 44. Similarly, second triangular end panel 27 is connected to the upper edge of back panel 2, and has lateral edges 32 and 33 which extend upwardly to score line 44.

On each side of triangular end panel 29 is a foldback panel. First foldback panel 41 is connected to triangular end panel 29 along edge 35, and to first roof wing panel 40 along score line 8. Panel 41 has a score line 44 as its upper edge. Similarly, second foldback panel 42 is connected to triangular end panel 29 along edge 36, and to second roof wing panel 43 along score line 9. It has score line 44 as its upper edge.

Similarly, third and fourth foldback panels 39 and 38 are connected to triangular end panel 27 along lateral edges 33 and 32, respectively. The third foldback panel 39 is attached to the first roof panel 28 along score line 7, and the fourth foldback panel 38 is connected to the second roof panel 30 by side seam flap 11 when the container is erected.

Attached to the upper edge of each foldback panel 38, 39, 41 and 42 along score line 44 is a gable rib panel 45, 46, 50 and 52, respectively. Similarly, attached to the upper edge of first and second roof panels 28 and 30 are first and second roof rib panels 48 and 54, respectively. First and second gable rib panels 50 and 52 are connected to each other at a common score line 51, and third and fourth gable rib panels 46 and 45 are connected to each other at common score line 47. The uppermost end 51A of line 51 is the tip of the pouring spout of the erected container. Alternatively, if a gable-top container does not include first and second gable rib panels the tip of the pouring spout is formed by the uppermost end of the first triangular end panel 29, where it connects with the first and second fold back panels.

First gable rib panel 50 is connected to first roof rib panel 48 at score line 8, and second gable rib panel 52 is connected to second roof rib panel 54 at score line 9.

First roof wing panel 40 comprises a triangular portion of first roof panel 28 defined by score lines 34, 44 and 8, and is adjacent first foldback panel 41. Second roof wing panel 43 comprises a triangular portion of second roof panel 30 defined by score lines 37, 44 and 9 and is adjacent second foldback panel 42. These roof wing panels are more or less coextensive with the adjacent foldback panel when the erected container is closed.

A first upper rib panel 49 is connected to the upper edge of the first roof rib panel 48. Likewise, a second upper rib panel 55 is connected to the upper edge of the second roof rib panel 54. The score lines 60 and 61 separate the upper rib panels from the adjacent roof rib panels, and are substantially continuous with the free upper edge 53 of the first and second gable rib panels 50 and 52. The latter panels serve as lips of the pouring spout of the erected container. However, the first and second upper rib panels are primarily provided to stiffen and strengthen the top of a sealed gable-top container. The presence of the first and the second upper rib panels is detrimental during the opening of a sealed gable-top container.

The score lines may be applied to blank 1A before or after the thermoplastic coating is applied to the blank. The score lines may be applied to either surface or both surfaces of the blank. For purposes of clearer delineation of the various panels, score lines are shown in the drawings on either or both of the inner and outer surfaces of the blank and container.

Containers of this type are opened for access to the contents by a two-step toggle action process. First, the gable edges of the roof panels at the front of the container are pushed outward and upward toward the rear of the container by thumb pressure, breaking the seal between the outside surfaces of the two lip panels, and breaking the seal in the rib panels surmounting the roof above the pouring spout. The gable edges are forced backward past the point at which the lip panels are joined, to nearly touch the roof panels.

Second, the gable edges are pushed forward and towards each other. The forces are communicated through spout panels to the tip of the pouring spout, breaking the seal between the lip panels and the underside of the roof panels and snapping the spout outward to a pouring position.

In early models of gable-top containers, the panels comprising the lips of the pouring spout were bonded to the underside of the roof panels. The resulting sealed spout was difficult to open, generally requiring insertion of a tool behind the lips to separate them from the roof underside. The cardstock panels often tore or delaminated, producing an unsightly and unsanitary container. In those cases where an adhesive was applied to only those panels which were to be joined, it was simple to eliminate adhesive from the spout panels to reduce the forces required to open the spout. The resulting container, of course, was not effectively sealed and was subject to leakage.

An improvement in gable-top containers to provide a hermetic seal for an extended shelf life package consisted of coating the inner surface of the container blank with a foil and an overcovering layer of thermoplastic such as polyethylene. The panels to be sealed are bonded by heating the thermoplastic surface coatings to a softening or melting temperature, compressing the panels together and cooling. The use of thermoplastic coatings or foil adds some stiffness to the panels, and the container is made resistant to wicking by liquids. However, the strong bonding of the lip panels results in buckling, tearing and delamination of the cardstock upon opening the seal. Thus, the spout is difficult to open, and the opened panels are unappealing in appearance.

As used in the food packaging industry, the term hermetic refers to a container designed and intended to be secure against the entry of oxygen which degrades flavor. The term is also used to designate containers used for aseptic filling and storage, i.e. containers secure against the entry of microorganisms. The hermetic barrier of such cartons typically comprises an aluminum or other barrier film coating the inner surface, overcovered with a thermoplastic such as polyethylene. The carton wall thickness is thus increased, resulting in larger channels where the edges of overlying panels have a stepped relationship in the gable rib area, increasing the chance for leakage.

Attempts to provide an easily opened spout seal have included: (a) perforations in the spout panels which tear open to expose pouring lips; (b) improved control of the sealing temperature; (c) the use of added scoreline patterns to concentrate the opening forces; and (d) the use of anti-adhesion agents, i.e. abhesives, to reduce the required opening forces.

The use of perforations in the spout panels has generally been unsatisfactory. Such perforations produce a spout of reduced size. The perforations are considered by some to be a weak point in the carton, prone to develop leaks. This type of carton spout requires external forces such as thumbnail pressure to open, and this procedure is considered unsanitary. The carton cannot be effectively closed, once opened, and shaking of the carton results in spillage.

Likewise, efforts to reduce temperature variations in the sealing process have not produced a satisfactory hermetic sealing gable-top container. Because of the narrow acceptable temperature range for obtaining the desired adhesion, sealing variations persist in spite of improved temperature control. Moreover, the required opening forces generally exceed the panel strength, even where minimal sealing is achieved.

The use of novel scoreline patterns generally has not overcome the strong sealing forces of well-sealed spouts and buckling of the spout panels is common.

One method for preventing the difficulty in opening the completely bonded lip panels of polyethylene coated gable-top containers is shown in Crawford et al, U.S. Pat. No. 3,116,002. In this reference, a thin coating of a high molecular weight organo-siloxane gum is applied to the lip panels as an abhesive, that is, to prevent permanent adhesion to the panels in contact with the lip panels.

Egleston et al, U.S. Pat. No. 3,270,940 discloses the use of an anti-adhesive composition applied to both the outside and inside surfaces of the pouring lip of a gable-top container. Abhesive agents disclosed include cellulose plastic laminated to polyethylene, the latter heat-bondable to the polyethylene surface of the cardstock blank.

The release properties of abhesives are generally affected by the heat sealing parameters and are inconsistent. Containers designed for hermetic use and having adhesives in the spout sealing area often require opening forces greater than the wall strength of the panels, and the spout panels buckle during the opening process.

European patent application No. 0,331,792, entitled "Easy Open Gable Top Carton" represents another approach to control the opening force for gable-top containers. Conventional gable-top container sealing apparatus and methods employ a pair of opposed sealing bars or jaws positioned adjacent the exterior of the overlapping pouring spout panels. Each sealing jaw includes a sealing surface for application to the exposed surfaces of the overlapping pouring spout panels. Means are provided for heating the container panels to a desired temperature sufficient for sealing of facing surfaces of the pouring spout panels of the gable-top container. Usually, such means takes the form of streams of heated air directed against the panels of the container to be sealed, in a manner known in the art, and thus will not be discussed herein further.

Means are also provided for movement of the sealing jaws from a spaced apart position to opposed positions in compressive contact with the panels to be sealed during the sealing of the gable-top container. The application of heat and the pressure of the sealing jaws will seal the gable-top container, as previously described.

Such sealing jaws are known in the art and the mechanism for moving the sealing jaws against the gable-top container panels and compressing the panels are also known in the art and will not be discussed in greater detail hereinafter.

The above mentioned European patent application no. 0,331,792 provides a pair of sealing jaws having aligned recesses. The recesses are positioned to apply a reduced level of sealing force or no sealing force to aligned potions of the overlapping panels of the end panels and side panels forming the gable top of the container. In the illustrated embodiment of a gable-top container blank, the corresponding panels are the first and the second roof rib panels 48, 54 and the first and the second gable rib panels 50, 52. The unsealed or lightly sealed areas on the overlapping panels are intended to reduce the opening force of the sealed container. However, even the arrangement in European patent application no. 0,331,792 does not adequately reduce the opening force to an acceptable level for gable-top containers including panels corresponding to the first and second upper rib panels 49, 55. Specifically, the arrangement described in European patent application no. 0,331,792 fails to recognize that a large portion of the opening force involves the separation of the first and second upper rib panels from each other and the subsequent buckling and deformation of these panels during the first phase of the opening process.

Moreover, recently gable-top containers have been developed for extended storage of food stuffs. Such designs have included tougher (e.g. thicker material or laminates having additional layers) laminates. Such gable-top containers, as illustrated in U.S. Pat. No. 4,787,507, drastically increase the effort required to open the container to an unacceptically high level, even for approaches as described in European patent application no. 0,331,792.

Thus, the limitations of conventional gable-top containers described herein are rendered more acute as the integrity of gable-top containers having first and second upper rib panels is increased. None of the existing gable-top container designs provide a secure seal and yet successfully facilitate easy and quick opening of a gable-top container including first and second upper rib panels.

DISCLOSURE OF INVENTION

The present invention is directed to an improvement in the formation of a package of paneled flexible material. The result is a more reliable, consistently openable spout for gaining access to the container contents. The container may be sealed to a leakproof or even a hermetically sealed condition if desired, yet is readily opened with minimal force. The flexible material may be cardstock, plastic, or other material with a thermoplastic inner surface coating which is sealed by elevated temperature and pressure. The flexible material may include a gas-impermeable film or foil layer.

The present invention provides a gable-top container having a thermoplastic inner surface coating. The gable-top container includes: (a) a container body having sides, a bottom and a top; (b) an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel, a first upper rib panel connected to an upper edge of the first roof rib panel and a second upper rib panel connected to an upper edge of the second roof rib panel; and (d) means for inducing buckling of the first and the second upper rib panels when the gable-top container is in a closed, sealed condition to reduce the force required to open the pouring spout.

The present invention also includes a method for constructing a gable-top container, comprising the steps of: (a) providing a gable-top container blank including a container body having side panels, a bottom and a top and an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, a first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel, a first upper rib panel connected to an upper edge of the first roof rib panel and a second upper rib panel connected to an upper edge of the second roof rib panel; (b) forming the gable-top container blank into a gable-top container; (c) sealing the pouring spout of the gable-top container; and (d) forming a yield point in the first and the second upper rib panels induce buckling of the first and the second upper rib panels as the pouring spout is opened, to reduce the force required to open the gable-top container.

The present invention also provides apparatus for sealing a gable-top container including a container body having side panels, a bottom and a top and an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, a first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel, a first upper rib panel connected to the first roof rib panel and a second upper rib panel connected to the second roof rib panel. The apparatus includes: (a) a pair of opposed jaws having facing sealing surfaces; (b) means for heating facing panels of the pouring spout panels to a temperature sufficient for reciprocal sealing; (c) means for pressing said sealing surfaces of said jaws against the outer surfaces of the first and second roof rib panels and the first and second upper rib panels with a desired pressure for a desired length of time to seal the gable-top container: and (d) means for reducing the reciprocal bond strength in a portion of the first and the second upper rib panels to reduce the force required to open the gable-top container.

BRIEF DESCRIPTION OF DRAWINGS

The present invention will be further described with reference to the accompanying drawing wherein like reference numerals refer to like parts in the several views, and wherein.

DETAILED DESCRIPTION

Figure 1:
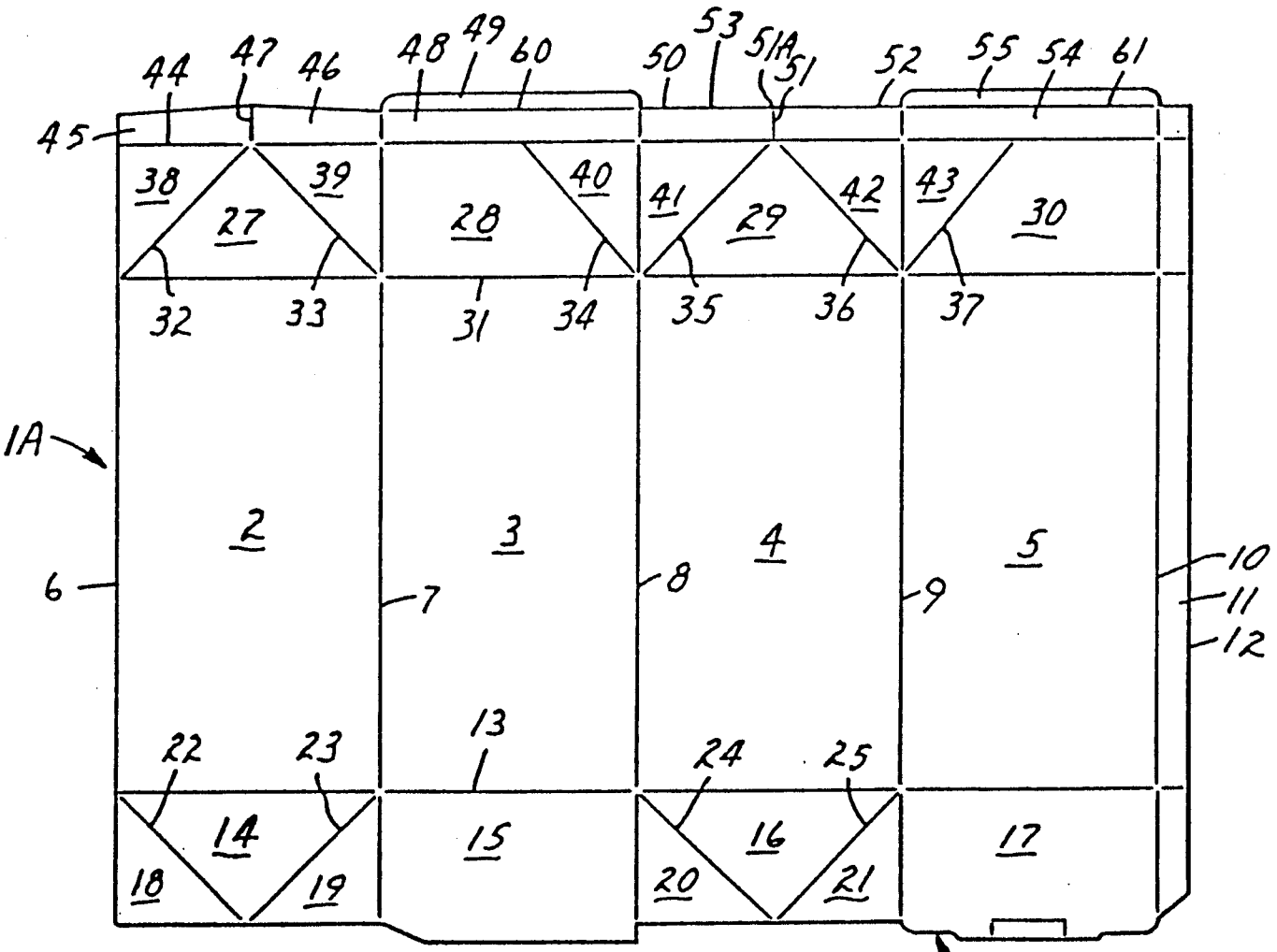
FIG. 1 is a plan view of a container blank according to one embodiment of the present invention.
Figure 2:
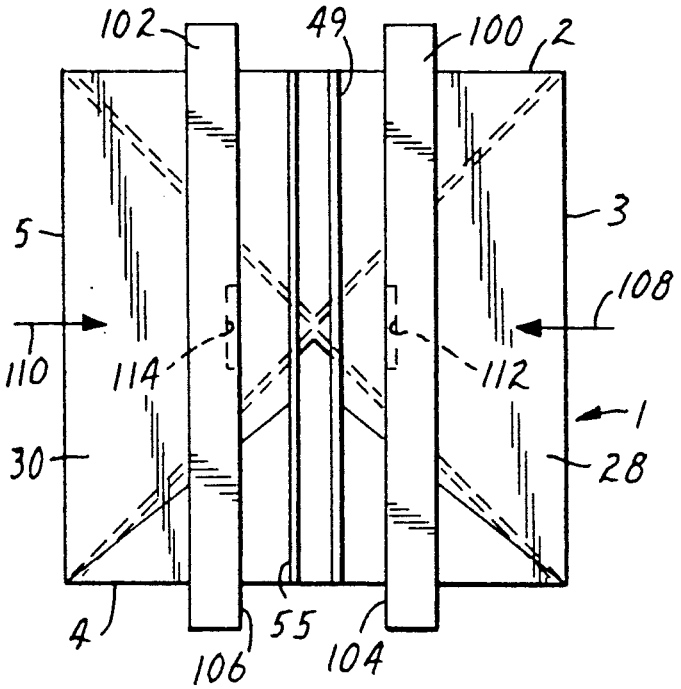
FIG. 2 is a top view of a gable-top container formed the blank of FIG. 1 partially erected but unsealed, with a pair of aligned sealing jaws.

Referring now to FIG. 2, the invention is depicted with reference to an partially erected but unsealed gable-top container in which the invention is incorporated. Container 1 is comprised of a series of panels as shown and described with respect to the gable-top container blank of FIG. 1, including a container body having four body panels 2–5, forming a container of rectangular cross-section. Usually, the cross-section is square. The bottom of the container 1 is closed. First roof panel 28 is connected to the upper edge of first side panel 3. Second roof panel 30 is connected to the upper edge of second side panel 5. When the container is in the closed condition, the roof panels 28 and 30 converge upwardly to form a gable roof construction. Roof rib panel 54 is attached to roof panel 30 and extends upwardly therefrom. Likewise, upper rib panel 55 is attached to roof rib panel 54 and extends upwardly therefrom.

First triangular end panel 29 is connected to the upper edge of the front body panel 4. When the container is closed, end panel 29 is folded under the gable roof formed by the two roof panels. Also shown are first roof wing panel 40 and second roof wing panel 43. The roof wing panels 40 and 43 are subpanels of roof panels 28 and 30, respectively. A second triangular end panel 27 is usually adapted to remain folded under the opposite gable roof, unless it is desired to open both gable ends of the container. In the illustrated embodiment, the pouring spout is formed from the first triangular end panel 29, first and second fold back panels 41 and 42, first and second wing panels, 40 and 43, first and second roof rib panels 48 and 54, and first and second upper rib panels 49 and 55, respectively. The first and second upper rib panels are provided primarily to stiffen the gable-top structure. Although, the first and the second upper rib panels 49, 55 are illustrated as extending across the full length of the first and second roof rib panels 48, 54, respectively, it is within the spirit and scope of this invention to provide a gable-top container in which the first and second upper rib panels are of different size, shape or location while being connected to the first and the second roof rib panels.

As previously described, the tip of the pouring spout is located at the uppermost end of 51A of scoreline 51 connecting the first and the second gable rib panels 50, 52, or alternatively, if the gable-top container does not include first and second gable rib panels, then the tip is formed at the uppermost end of the first triangular end panel 29 and the first and the second foldback panels 50 and 52.

It is to be understood that in its broadest sense, the present invention is equally applicable to any gable-top container suitable for the packaging of materials and particularly liquids, and to blanks from which the containers are formed. Such gable-top containers must include a container body, having at least one side panel (i.e. if the container is cylindrical, it may have only one side panel) a bottom, a top and an extensible pouring spout connected to the container top. The other panels of the container body described herein with respect to the illustrated embodiment may be modified in number, size, shape or configuration without altering the scope of this invention. In all other respects, the gable-top container and blank of this invention are as hereinabove described.

As previously described herein, a gable-top container is formed from a blank of paperboard or other suitable material coated on the inner planar surface, or on both the inner and outer surfaces with a thermoplastic material. The container blank is adapted to be erected and have certain panels sealed to each other by a container sealing process. Typically, the sealing process consists of compressing together the panels to be joined while those panels are at an elevated temperature. Other alternative sealing processes may also be utilized.

Figure 3:
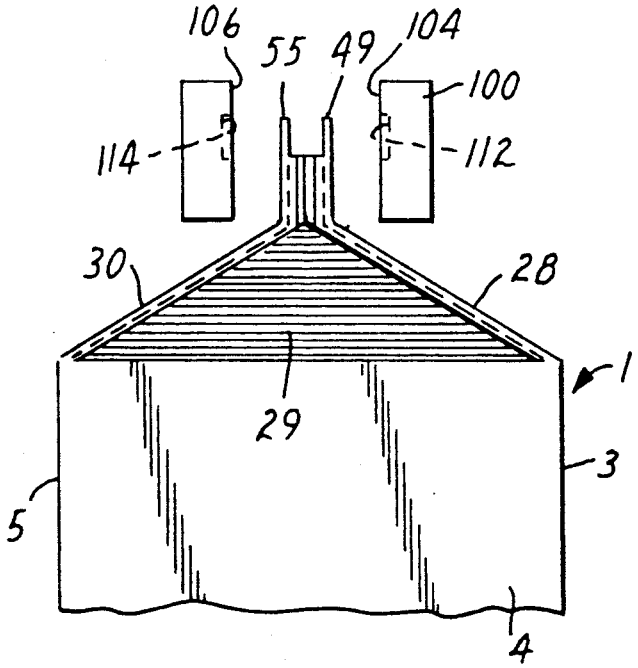
FIG. 3 is an end view of the gable-top container of FIG. 2 after sealing by the sealing jaws.

As previously discussed herein, conventional gable-top container sealing apparatus and methods employ a pair of opposed sealing bars or jaws 100 and 102, as shown in FIG. 2 prior to sealing of the gable-top container and in FIG. 3 subsequent to sealing of the gable-top container, positioned adjacent the exterior of the first and second roof rib panels, 50 and 52, and first and second upper rib panels, 49, 55, respectively. Each sealing jaw includes a sealing surface, 104 and 106, respectively, for compressive application to the exposed surfaces of the first and the second roof rib panels. Means are provided for heating the container panels to a desired temperature sufficient for sealing of facing surfaces of the pouring spout panels of the gable-top container. Usually, such heating means takes the form of streams of heated air directed against the panels of the container to be sealed, in a manner known in the art, and thus will not be discussed herein further.

Means are also provided for movement of the sealing jaws 100 and 102, such as in opposed directions 108 and 110, from a spaced apart position as shown in FIG. 2 to opposed positions in compressive contact with the first and second roof rib panels 50 and 52, and first and second upper rib panels 49, 55, during the sealing of the gable-top container. The application of heat and the pressure of the sealing jaws will seal the gable-top container, as previously described. Such sealing jaws are known in the art and the mechanism for moving the sealing jaws against the gable-top container panels and compressing the panels are also known in the art and will not be discussed in greater detail hereinafter. The following companies are sources of commercially available machines for sealing gable-top containers that may utilized in the method and apparatus of the present invention: Cherry-Burell of Cedar Rapids, Iowa and Pure-Pak of Walled Lake, Mich.

The present invention provides means for reducing the force required to open a gable-top container by inducing buckling of the first and second upper rib panels 49, 55. The inducement of buckling by the first and the second upper rib panels may be accomplished in several ways. For instance, the bond strength between portions of facing surfaces of the first and second upper rib panels may be reduced, compared to the remainder of the facing surfaces of the first and second upper rib panels. This establishes a "yield point" during the first phase of the two step opening process previously described herein. The premature separation of the first and second upper rib panels at the yield point facilitates and physically accommodates buckling of the first and second upper rib panels during the first phase of the opening process and thus reduces the opening force required. The yield point may be located at any desired point along the length of the first and second upper rib panels that provides the benefit of inducing buckling therein during the opening of the gable-top container. However, preferably, the yield point constitutes a minor portion of the first and second upper rib panels and is located between the tip of the pouring spout when the gable-top container is in its closed and sealed position, and the front of the container. Most preferably, the yield point is located adjacent to the location of the tip of the pouring spout when the gable-top container is in its closed and sealed position.

The level of the bond strength of the facing surfaces of the first and second upper rib panels is determined by the adhesive coating on the surfaces, the length of time, temperature and pressure of the sealing process, among other factors. Any of these variables may be reduced individually or in various combinations in a localized area on the first and second upper rib panels to selectively reduce the bond strength of the sealed gable-top container.

Figure 4:
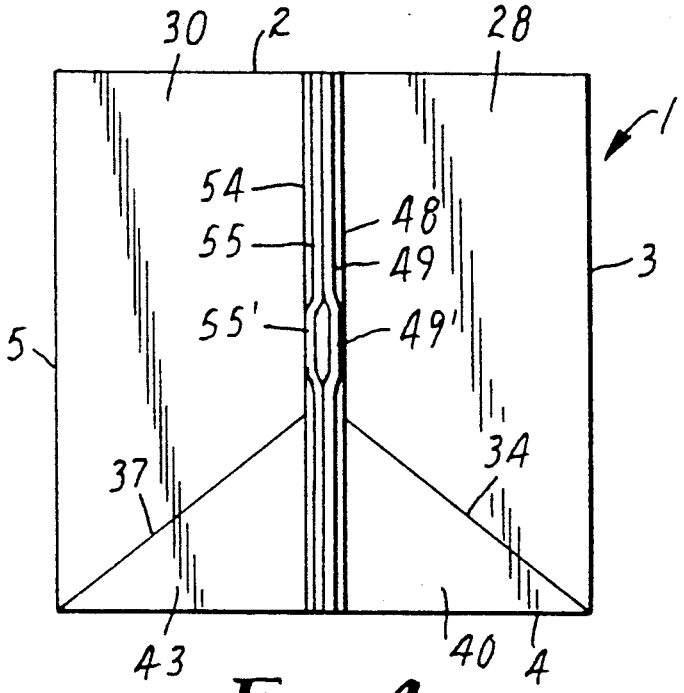
FIG. 4 is a top view of the container of FIG. 2, with the top sealed by the sealing jaws.
Figure 5:
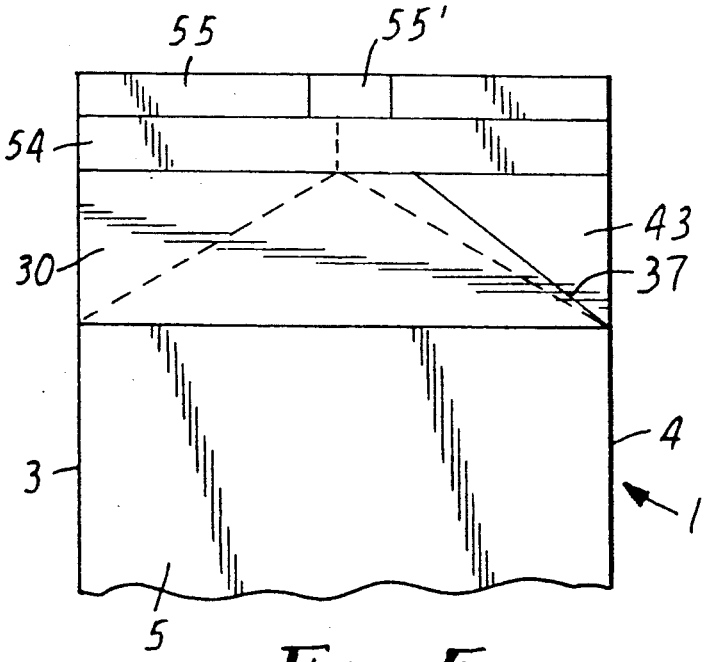
FIG. 5 is a side view of the sealed container of FIG. 4.

For instance, as is shown in FIGS. 3–5, means are provided in the illustrated embodiment for applying a first, lower sealing pressure to first portions 49', 55' of the first and second upper rib panels and applying a second, higher sealing pressure on remaining portions of the first and the second upper rib panels sufficient for reciprocal sealing of the first and second upper rib panels 49, 55 and sealing the first and second gable rib panels 50, 52 to the first and second roof rib panels 48, 54 of the container.

Figure 2A:
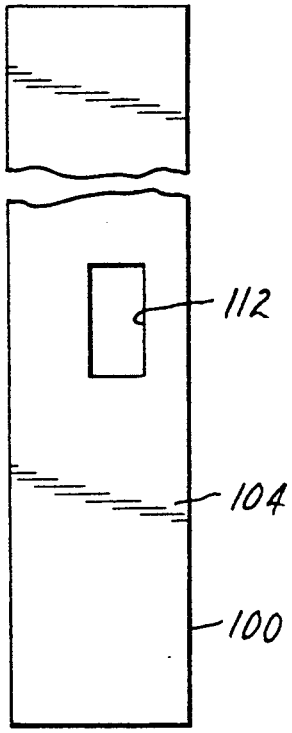
FIG. 2A is a side view of one of the sealing jaws of FIG. 2.

In the illustrated embodiment, the means for applying a differential sealing pressure to the first and second portions of the first and second upper rib panels include a pair of recesses or indents 112 and 114, shown in greater detail in FIG. 2A, each formed in aligned, opposing locations on the sealing surfaces 104 and 106 of the sealing jaws 100 and 102. The recesses 112, 114 are constructed so as to generally overly the first portions 49', 55' of the first and second upper rib panels that are desired to buckle during the first phase of the opening of the sealed closed gable-top container.

It will be appreciated that the pair of indents or recesses 112, 114 reduce and limit the level of compressive sealing force applied to the first portions 49', 55' of the first and second upper rib panels 49, 55 compared to the compressive sealing force applied to remainder of the first and the second upper rib panels. By constructing the recesses in an appropriate manner the level of compressive force applied to each portion of the first and second upper rib panels can be carefully controlled. The relief or recess should be at least nominally the thickness of the gable-top container blank, but is preferably 0.010 inches (0.0.025 cm) to 0.015 inches (0.038 cm) deeper in each jaw. It is one of the advantages of this invention that the method may be practiced and the apparatus constructed by relatively minor and inexpensive modifications of conventional gable-top container sealing systems.

FIGS. 3–6 each show a gable-top container 1 sealed according to the method and apparatus of this invention. Portions 49', 55' of the first and second upper rib panels 49, 55 have a thickness that is perceptively larger relative to the remainder of the first and the second upper rib panels.

Figure 7:
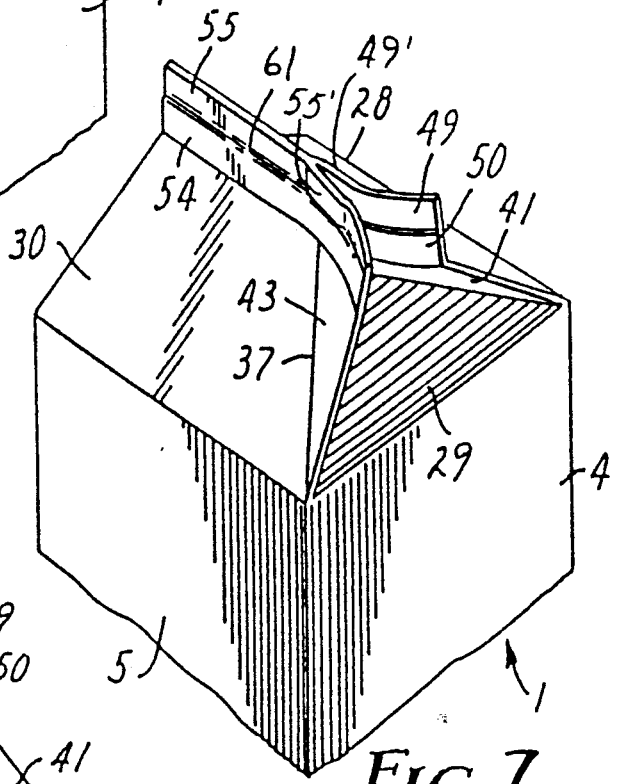
FIG. 7 is an isometric view of the upper portion of the sealed gable-top container of FIG. 6, with a partially opened rib.
Figure 8:
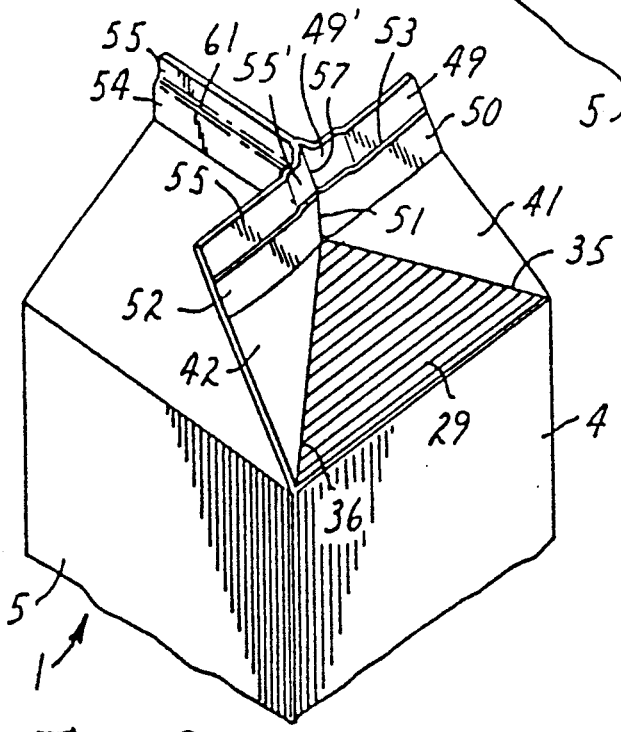
FIG. 8 is an isometric view of the upper portion of the sealed gable-top container of FIGS. 6 and 7, with the sealed spout fully opened and the spout panels in a closed position.
Figure 9:
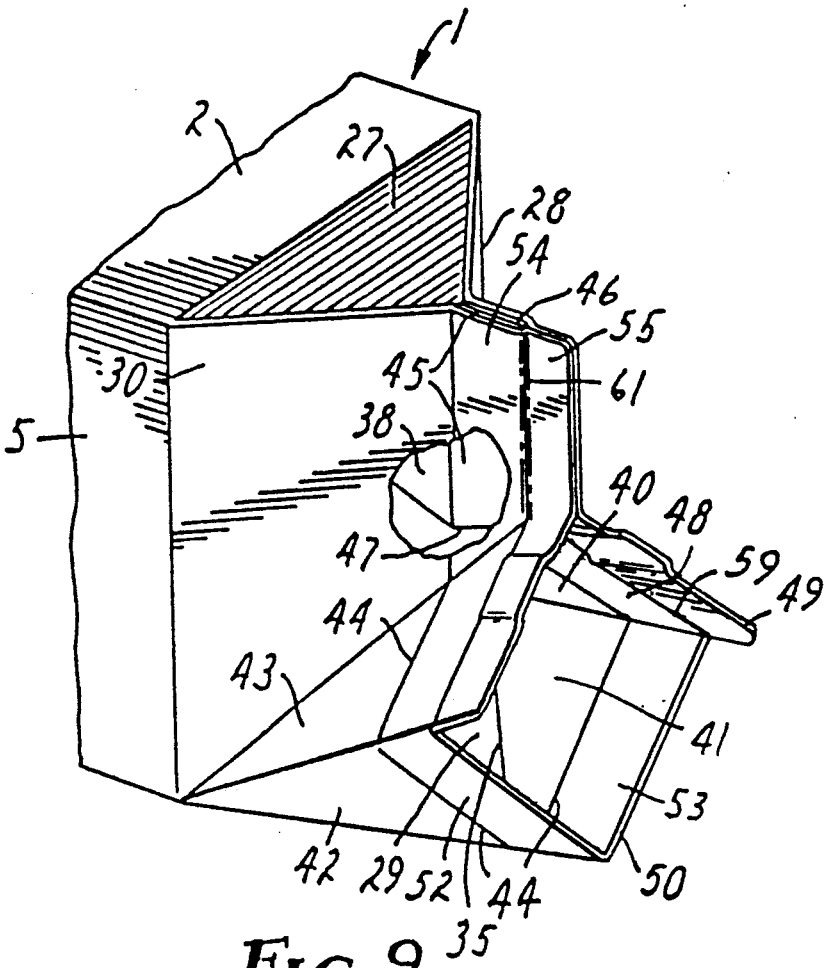
FIG. 9 is an isometric view of the upper portion of the sealed gable-top container of FIGS. 6–8 with the pouring spout fully opened and a portion of the the container cut away to view panel members below the roof and roof rib panels.

Such portions 49' and 55' are also shown in each of FIGS. 7–9 as the gable-top container 1 is being opened. FIG. 7 shows the container of FIG. 2 in which the spout has been partially opened. The first and second foldback panels 41 and 42 and overlapping roof wing panels 40 and 43 are typically pushed outward and backward with thumb pressure to break the seal between the inner surfaces of the first and second upper rib panels 49 and 55, and between the outer surfaces of the first and second gable rib panels 50 and 52, the latter not visible in this drawing. The gable rib panels are connected to the upper edge of foldback panels 41 and 42, and extend upwardly therefrom.

FIG. 8 shows the container at the point where foldback panels 41 and 42 have been pushed backward about 90 degrees from their sealed position. These panels are roughly triangular in shape, each having one edge defined by scoreline 35 or 36, where they are attached to a lateral edge of first triangular end panel 29. First and second gable rib panels 50 and 52 act as lips of the pouring spout, and meet at a common gable rib score line 51, forming a tip for the pouring spout. The upper terminus 51A of the common rib score line at the free edge 53 of the pouring lip comprises the tip of the pouring spout. First and second upper rib panels 49 and 55 extend upwardly from the first and second roof rib panels 48 and 54 to a level higher than the free upper edge 53 of gable rib panels 50 and 52.

It will be appreciated that the relatively lower sealing pressure applied to first portions 49' and 55' of the first and second upper rib panels 49, 55 results in a relatively lower bond strength between the facing surfaces of the first and the second upper rib panels 49 and 55 in those portions. Thus, as the pouring spout is being opened as shown in FIGS. 7 and 8, the weakness adjacent the pouring spout tip reduces the force required to separate the first and second upper rib panels. Once the first and second upper rib panels are separated at the yield point, the force applied to the pouring spout panels during the remainder of the first phase of the opening process are attenuated by continued buckling and deformation of the first and the second upper rib panels.

To complete the unsealing and opening of container 1, in the second phase of the opening process foldback panels 41 and 42 are pushed backward beyond the position shown in FIG. 8. The roof rib panels and upper rib panels will fold along foldline 57. The blank may or may not be scored at that location. The gable rib panels are slightly longer than the roof rib panels. Thus, after the panels are folded backward, a subsequent forward and inward movement of wing panels 40 and 43 transmits opening forces in a toggle-like action along the wing panels and gable rib panels 50 and 52 toward the common line 51 between the gable rib panels. A component of these forces extends outward and upward from line 51 and from gable score lines 35 and 36 to pull the gable rib panels 50 and 52 away from roof rib panels 54 and 48, the latter not visible in FIG. 8, and to pull foldback panels 41 and 42 away from roof wing panels 40 and 43. Likewise, triangular end panel 29 is forced outward, and the distended panels extend a pouring spout, as shown in FIG. 9. The various score lines delineating the panels act as hinges for the panels as they are unfolded.

The force required to distend the spout in this fashion may be calculated theoretically. If the gable rib panels are looked upon as a beam which is to be buckled in the center, the force P required for buckling to occur may be described as:

$$P=CEI/(L^2)$$

where $C=(\pi^2)=9.87$ for hinged ends.

E=modulus of elasticity of beam.

I=moment of inertia of the beam.

$I=bh^3/12$ where b=width and h=thickness of the beam. and

L=length of the beam.

Analysis of the opening forces is complex. In general however, the gable rib panels, foldback panels, and roof rib panels must be relatively stiff to prevent these panels from crumpling, and to transmit the applied opening forces to common line 51. The sealing forces which bond the gable rib panels to the roof rib panels are preferably only as high as required to maintain the hermetic seal.

Although the illustrated embodiment of the invention include a pair of one piece sealing jaws, each having a recess formed in a sealing surface, it is within the spirit and scope of the present invention to provide sealing jaws having independent portions, one aligned with the location of the "yield point" of the first and second upper rib panels and the second aligned with the remainder of the first and second upper rib panels. In this arrangements, the independent portions of the sealing jaws could be applied to different portions of the first and the second upper rib panels with independent levels of compressive sealing forces by a mechanism (not shown) adapted for this purpose. Further, such independent sealing jaw portions could be applied for differing periods of time to likewise alter the bond strength. Finally, it is within the spirit and scope of this invention to provide a mechanism (not shown) for heating different portions of the first and the second upper rib panels to different temperatures, with a similar effect on the bond strength. Each of these embodiments of the present invention may be utilized alone or in various combinations with one or more of the other alternative methods for forming a "yield point" in the first and second upper rib panels.

Figure 10:
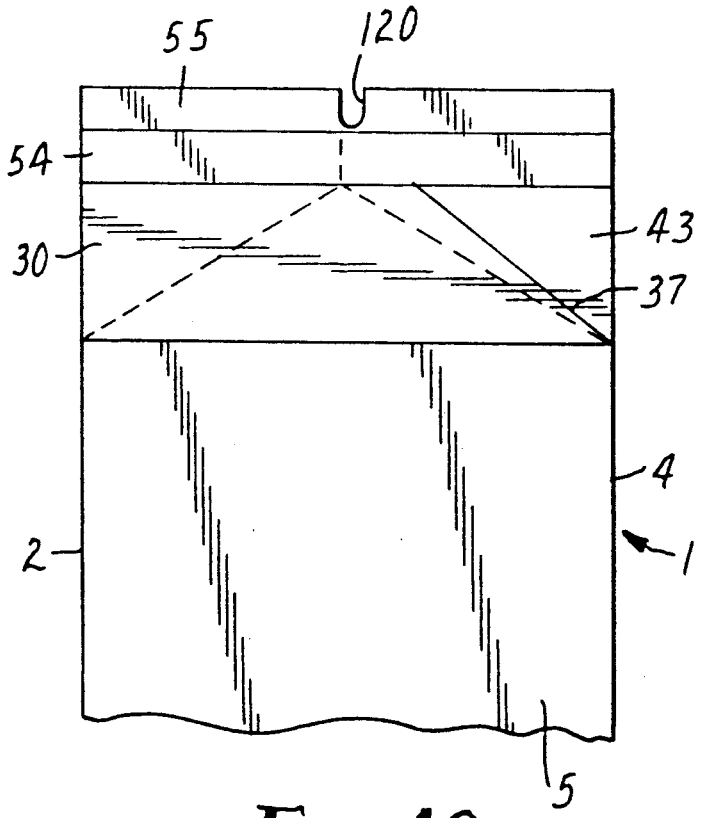
FIG. 10 is a side view of an alternate embodiment of the invention in which a sealed gable-top container includes a notch cut in the first and second upper rib panels intermediate the tip of the pouring spout and the midpoint of the first and the second upper rib panels.
Figure 5A:
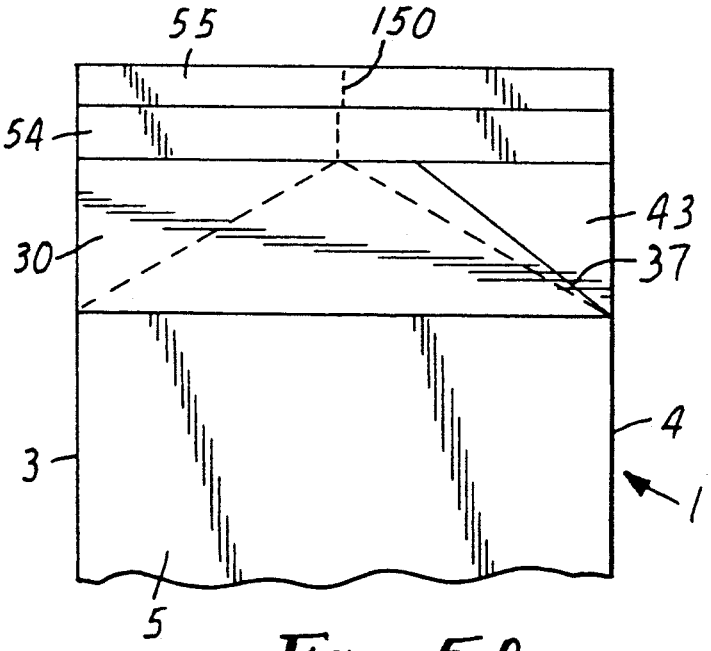
Figure 6:
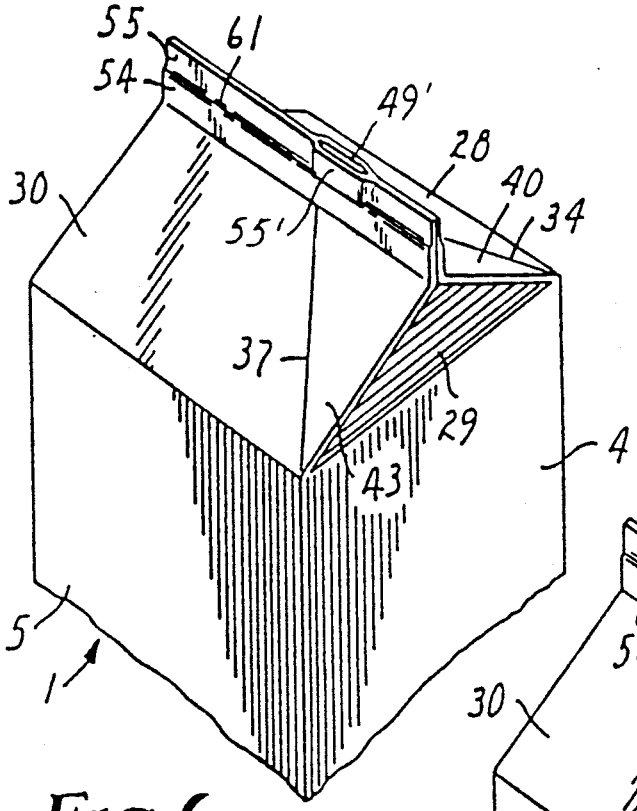
FIG. 6 is an isometric view of the upper portion of the sealed gable-top container of FIG. 5.

FIG. 10 illustrates another alternate embodiment of this invention that incorporates a notch 120 formed in the first and second upper rib panels, most preferably adjacent and just forward of the tip of the pouring spout when the gable-top container is in its closed and sealed position. The notch forms a "yield point" that induces buckling in the first and second upper rib panels as the pouring spout is being opened. This arrangement also inherently reduces the surface area that is reciprocally bonded between the first and the second upper rib panels. Moreover, the notch provides a physical space to receive the material of the first and second upper rib panels as they are displaced during buckling. Although a generally "U" shaped notch is illustrated, the notch may be constructed with any size or shape as is found advantageous for a particular gable-top container, including a slit or the like. Alternatively, the means for inducing buckling may be formed by prescoring one or more transverse lines through the first and second upper rib panels. Buckling of the first and the second upper rib panels is induced by the scorelines in a lateral direction without requiring separation of the upper rib panels from each other. In this embodiment, unmodified sealing jaws may be employed to seal the gable-top container.

Figure 11:
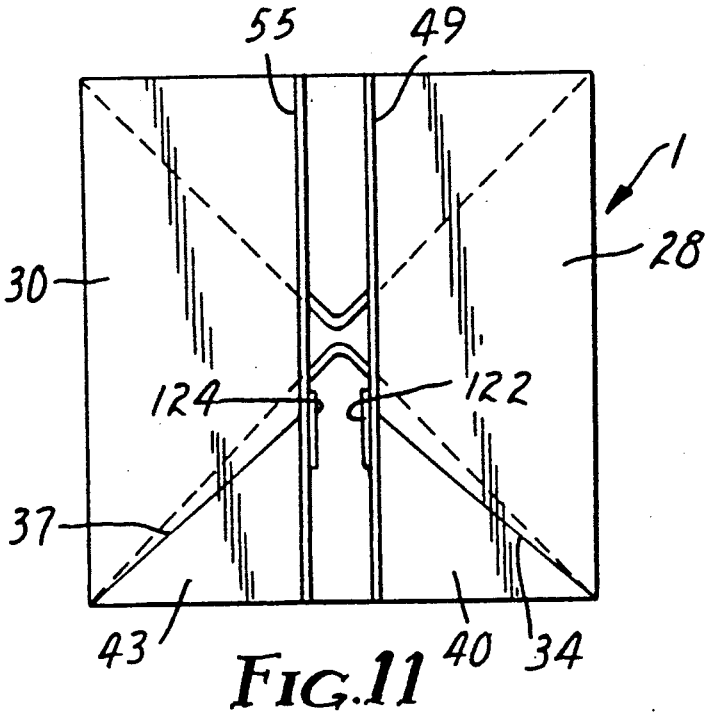
FIG. 11 is a top view of a partially erected but unsealed alternate embodiment of the invention in which an abhesive is applied to facing portions of the first and second upper rib panels intermediate the tip of said pouring spout and the midpoint of the first and the second upper rib panels.

FIG. 11 illustrates yet another alternate embodiment of this invention in which first portions 49' and 55' of facing surfaces of the first and second upper rib panels 49, 55 are coated with an abhesive, i.e. a substance to reduce the level of the bond strength of the first and second upper rib panels to each other. The following is a non-exclusive list of abhesive substances that may be employed in conjunction with this invention: organo-Silioxane gum, as disclosed in U.S. Pat. No. 3,116,002, the contents of which are incorporated herein; cellophane, as disclosed in U.S. Pat. No. 3,116,002, the contents of which are incorporated herein; and Dow Corning 7 compound release agent. As in the case of the embodiment of this invention shown in FIG. 10, unmodified sealing jaws may be employed to seal the gable-top container in this embodiment. Previous attempts to utilize abhesives to reduce the level of opening force for gable-top containers have not utilized the abhesive in a localized, defined portion of the facing surfaces of the first and the second upper rib panels to create a "yield point" in the upper rib panels to induce buckling of those panels as the gable-top container is being opened.

One of the advantages of the present invention is that the method and apparatus for producing a gable-top container and inducing the first and the second upper rib panels to buckle during the opening process does not interfere with the effective sealing of the first and the second roof rib panels to the first and the second gable rib panels to seal the gable-top container. None of the prior art gable-top container constructions involved a method or apparatus for inducing buckling in the first and second upper rib panels. In contrast, previous approaches to reduce the force required to open a gable-top container have been directed to reducing the bonding force between the first and second roof panels and the first and second gable rib panels, or equivalents, such as in the previously discussed European Patent application no. 0,331,792, thereby reducing the integrity of the seal of the gable-top container.

The following are Examples 1 and 3–8 are exemplary gable-top containers constructed according to the present invention. Example 2 is an example of a comparative conventional gable-top container.

EXAMPLE 1

A two (2) liter foil lined Tetra Rex gable top container blank available from Tetra-Pak, Inc. of Shelton, Conn. and corresponding to the gable-top container blank shown in FIG. 1 and described herein was heat sealed by a Model 010 hand sealer available from Liqui-Pak International, Inc., using a power setting of 90–100. The sealing temperature on the carton was approximately 300° F. A 0.3 inch (0.762 cm) diameter hole was cut out of the midpoint of the first and second upper rib panels after being reciprocally sealed. To test the opening force of the sealed gable-top container, a hole was punched through both the first foldback panel and the first roof wing panel. A wire was inserted through the hole, and the wire was attached to a ring stand. A second hole was then punched through the second foldback panel and the second roof wing panel, and a spring gauge was attached to the second hole. The spring gauge was a 0–10 pound spring gauge available from Ametek, Inc. of Hatfield, Pa. The opening force was measured by pulling on the strain gauge and recording the initial force required to open the carton during the first phase of the opening process. Test results are recorded in Table 1. When the first phase of the opening process was nearly completed, the first and the second gable rib panels snapped forward to begin forming the tip of the pouring spout.

EXAMPLE 2

A two (2) liter gable-top container blank was erected and sealed as described in Example 1. The first and second upper rib panels were unmodified with the opening force of the gable-top container tested as described in Example 1. The opening force is recorded in Table 1 and shows that Example 1 requires about approximately 14% less force to open than !he comparative unmodified gable-top container. Additionally, it was observed that the first and second gable rib panels did not release easily at the end of the first phase of the opening process to begin extending the pouring spout.

EXAMPLE 3

A two (2) liter carton was erected and sealed as described in Example 1. A 0.625 inch (1.59 cm) radius notch was cut out of the middle of the first and second upper rib panels which are reciprocally sealed together. The notch has a depth of 0.2 inch (0.0508 cm) from the upper edge of the first and second upper rib panels. The opening force of the gable-top container was tested as described in Example 1 and results are shown in Table 1.

It was observed that the first and the second gable rib panels began to snap open at the end of the first phase of the opening process as in Example 1.

EXAMPLE 4

A two (2) liter gable-top container was erected and sealed as described in Example 1 except that the sealing jaws had aligned 0.5 inch (1.27 cm) long and 0.035 inch (0.089 cm) deep reliefs in the area of the first and second upper rib panels adjacent the pouring spout of the erected and sealed container.

EXAMPLE 5

A two (2) liter Tetra-Rex gable-top container, as in Example 1, was coated with Dow Corning 7, a release compound from Dow Corning Corporation of Midland, Mich., in a 1 inch (2.54 cm) long area extending from 0.2 inch (0.508 cm) past the midpoint of the upper rib panels into the area of the upper rib panels above the spout. The container was sealed as in Example 1, except that the jaws had 1 inch (2.54 cm) long and 0.035 inch (0.089 cm) deep reliefs corresponding to the release coated areas in the upper rib panels. The container was opened and the gable rib panels snapped open to begin forming a pouring spout.

EXAMPLE 6

A two (2) liter gable-top container was erected and sealed as described in Example 1. A single vertical slit was cut 0.125 inch (0.32 cm) from the midpoint of the upper rib panels and above the gable rib panels. The container was opened and the gable rib panels snapped open to begin forming a pouring spout.

EXAMPLE 7

(Comparative)

A two (2) liter container was erected from a container blank, as described in U.S. Pat. No. 4,787,507, incorporated herein by reference, and sealed as in Example 1. The container was tested as described in Example 1. The initial opening force 11.1 pounds (49.7 Newtons) and the propagating force during the remainder of first phase of the opening process was 10.8 pounds (48.0 Newtons).

EXAMPLE 8

A two (2) liter container, as described in Example 7, was erected and sealed, as described in Example 5, without the release compound coating. The initial opening force was 11.2 pounds (49.8 Newtons) and the propagating force during the remainder of the first phase of the opening process was 7.2 pounds (32. Newtons). This example shows that the container of the present invention requires approximately 33% less force to continue the opening process as a conventionally sealed container.

TABLE 1

| | Initial Opening Force | |
|---|---|---|
| Example | Pounds | Newtons |
| 1 | 7.8 | 34.7 |
| 2 (Comparative) | 9.1 | 40.5 |
| 3 | 8.5 | 37.8 |
| 4 | 8.2 | 36.5 |

The present invention has now been described with reference to several embodiments thereof. It will be apparent to those skilled in the art that many changes can be made in the embodiments described without departing from the scope of the present invention. For instance, although the gable-top container described herein has been referred to as hermetically sealed, the method and apparatus of this invention are also applicable to non-hermetic sealing of a gable-top container, if desired. Further, the gable-top container of this invention may be used to contain solids as well as liquids. Thus, the scope of the present invention should not be limited to the structures described in this application, but only by structures described by the language of the claims and the equivalents of those structures.

What is claimed is:

1. A gable-top container having a thermoplastic inner surface coating, said container comprising:

(a) four body section panels including front and back panels and first and second side panels;

(b) bottom closure panel means for closing the bottom of said container;

(c) first and second oppositely disposed roof panels connected to the upper edges of said first and second side panels, respectively;

(d) first and second opposed substantially triangular end panels connected to the upper edges of said front and back body section panels, respectively, and extending upwardly therefrom;

(e) first and second foldback panels, said first foldback panel connected to said first roof panel and to one lateral edge of said first triangular end panel, and said second foldback panel connected to said second roof panel and to the other lateral edge of said first triangular end panel;

(f) third and fourth foldback panels, said third foldback panel connected to said first roof panel and to one lateral edge of said second triangular end panel, and said fourth foldback panel connected to the other lateral edge of said second triangular end panel and connected to said second roof panel;

(g) first and second gable rib panels connected to the upper edges of said first and second foldback panels, respectively, and extending upwardly therefrom, and to each other at a common line;

(h) third and fourth gable rib panels connected to the upper edges of said third and fourth foldback panels, respectively, and to each other;

(i) first and second roof rib panels connected to the upper edges of said first and second roof panels, respectively, each said roof rib panel connected at one side thereof to one of said first and second gable rib panels;

(j) first and second upper rib panels connected to the upper edges of said first and second roof rib panels, respectively;

(k) first roof wing panel comprising a triangular portion of said first roof panel adjoining said first foldback panel and said first roof rib panel and connected thereto;

(l) second roof wing panel comprising a triangular portion of said second roof panel adjoining said second foldback panel and said second roof rib panel, and connected thereto;

(m) said first triangular end panel, said first and said second foldback panels, said first and said second roof wing panels, said first and said second roof panels, said first and said second gable rib panels, said first and said second roof rib panels, and said first and said second upper rib panels forming an extensible pouring spout for dispensing the contents of the containers; and (n) means for inducing buckling of said first and said second upper rib panels to reduce the opening force required to open the gable-top container.

2. The gable-top container of claim 1, wherein said means for inducing buckling includes a notch formed in said first and second upper rib panels adjacent a tip of said pouring spout when the gable-top container is in a closed, sealed condition.

3. The gable-top container of claim 1, wherein said means for inducing buckling includes a prescored line formed in said first and second upper rib panels adjacent a tip of said pouring spout when the gable-top container is in a closed, sealed condition.

4. The gable-top container of claim 1, wherein said means for reducing the opening force includes a layer of abhesive applied to at least one of the facing surfaces of said first and second upper rib panels adjacent a tip of said pouring spout when the gable-top container is in a closed, sealed condition.

5. The gable-top container of claim 1, wherein said means for reducing the opening force includes a portion of said first and second upper rib panels adjacent a tip of said pouring spout when the gable-top container is in a closed, sealed condition being bonded with a strength less than the bond strength of the remainder of said first and second upper rib panels.

6. A gable-top container having a thermoplastic inner surface coating, said container comprising:

(a) a container body having sides, a bottom and a top;

(b) an extensible pouring spout including a generally triangular end panel connected to said container body top and extending upwardly therefrom, first and second foldback panels, said first foldback panel connected to said container body top and to one lateral edge of said first triangular end panel, and said second foldback panel connected to said container body top and to the other lateral edge of said first triangular end panel, first roof wing panel adjoining said first foldback panel and connected thereto, a second roof wing panel adjoining said second foldback panel and connected thereto, a first roof rib panel connected to said first roof panel and said first roof wing panel, a second roof rib panel connected to said second roof panel and said second roof wing panel, a first upper rib panel connected to an upper edge of said first roof rib panel and a second upper rib panel connected to an upper edge of said second roof rib panel; and (c) means for inducing buckling of said first and said second upper rib panels when said pouring spout is being opened to reduce the force required to open said pouring spout.

7. The gable-top container of claim 6, wherein said means for inducing buckling includes a notch formed in said first and second upper rib panels adjacent a tip of said pouring spout when the gable-top container is in a closed, sealed condition.

8. The gable-top container of claim 6, wherein said means for reducing the opening force includes a layer of abhesive applied to at least one of the facing surfaces of said first and second upper rib panels adjacent a tip of said pouring spout when the gable-top container is in a closed, sealed condition.

9. The gable-top container of claim 6, wherein said means for reducing the opening force includes a portion of said first and second upper rib panels adjacent a tip of said pouring spout when the gable-top container is in a closed, sealed condition being bonded with a strength less than the bond strength of the remainder of said first and second upper rib panels.

10. A method for constructing a gable-top container, comprising the steps of:

(a) providing a gable-top container blank including a container body having side panels, a bottom and a top and an extensible pouring spout including a generally triangular end panel connected to the container body top and extending upwardly therefrom, first and second foldback panels, the first foldback panel connected to the container body top and to one lateral edge of the first triangular end panel, and the second foldback panel connected to the container body top and to the other lateral edge of the first triangular end panel, a first roof wing panel adjoining the first foldback panel and connected thereto, a second roof wing panel adjoining the second foldback panel and connected thereto, a first roof rib panel connected to the first roof panel and the first roof wing panel, a second roof rib panel connected to the second roof panel and the second roof wing panel; a first upper rib panel connected to an upper edge of said first roof rib panel and a second upper rib panel connected to an upper edge of said second roof rib panel;

(b) forming the gable-top container blank into a gable-top container;

(c) sealing the pouring spout of the gable-top container; and (d) forming a yield point in the first and second upper rib panels to induce buckling of the first and the second upper rib panels as the pouring spout is opened, to reduce the force required to open the gable-top container.

11. The method of claim 10, wherein step (d) further includes the step of forming a notch in the first and the second upper rib panels adjacent a tip of the pouring spout when the gable-top container is in a closed, sealed condition.

12. The method of claim 10, wherein step (d) further includes the step of forming a prescored line in the first and the second upper rib panels adjacent a tip of the pouring spout when the gable-top container is in a closed, sealed condition.

13. The method of claim 10, wherein step (d) includes the step of weakening the reciprocal bond strength of the first and the second upper rib panels adjacent a tip of the pouring spout when the gable-top container is in a closed, sealed condition.

14. The method of claim 13, wherein the step of weakening the reciprocal bond strength of the first and the second upper rib panels includes the step of applying an abhesive to a portion of facing surfaces of at least one of the first and the second upper rib panels adjacent a tip of the pouring spout when the gable-top container is in a closed, sealed condition.

15. The method of claim 13, wherein the step of weakening the reciprocal bond strength of the first and the second upper rib panels includes the step of applying a first sealing pressure to a portion of the first and the second upper rib panels adjacent a tip of the pouring spout when the gable-top container is in a closed, sealed condition and a second sealing pressure to the remainder of the first and the second upper rib panels.

16. The method of claim 13, wherein the step of weakening the reciprocal bond strength of the first and the second upper rib panels includes the step of applying a first sealing temperature to a portion of the first and the second upper rib panels adjacent a tip of the pouring spout when the gable-top container is in a closed, sealed condition and a second sealing temperature to the remainder of the first and the second upper rib panels.

17. The method of claim 13, wherein the step of weakening the reciprocal bond strength of the first and the second upper rib panels includes the step of applying a sealing pressure for a first period of time to a portion of the first and the second upper rib panels adjacent a tip of the pouring spout when the gable-top container is in a closed, sealed condition and a sealing pressure for a second period of time to the remainder of the first and the second upper rib panels.

* * * * *